United States Patent [19]

Mucheyer

[11] Patent Number: 4,777,797

[45] Date of Patent: Oct. 18, 1988

[54] HYDRAULIC SYSTEM WITH SUCTION MAINTENANCE OF ITS CONTROL PUMP

[75] Inventor: Norbert Mucheyer, Rechtenbach, Fed. Rep. of Germany

[73] Assignee: Mannesmann Rexroth GmbH, Fed. Rep. of Germany

[21] Appl. No.: 807,983

[22] Filed: Dec. 12, 1985

[30] Foreign Application Priority Data

Dec. 13, 1984 [DE] Fed. Rep. of Germany ..... 3445516

[51] Int. Cl.[4] ..... F15B 20/00

[52] U.S. Cl. ..... 60/329; 60/403; 60/452

[58] Field of Search ..... 60/445, 452, 403, 329; 417/218, 222

[56] References Cited

U.S. PATENT DOCUMENTS

| | | | |
|---|---|---|---|
| 2,674,191 | 4/1954 | Ifield | 417/218 X |
| 2,753,803 | 7/1956 | Lawrence | 417/218 |
| 3,846,982 | 11/1974 | Rometsch et al. | 60/445 |
| 4,037,993 | 7/1977 | Roberts | 417/222 |
| 4,325,677 | 4/1982 | Nonnenmacker | 417/218 |
| 4,480,963 | 11/1984 | Ring | 417/222 X |
| 4,518,322 | 5/1985 | Nonnenmacker | 417/218 X |

*Primary Examiner*—Gerald A. Michalsky

*Attorney, Agent, or Firm*—Ostrolenk, Faber, Gerb & Soffen

[57] ABSTRACT

A hydraulic system having an axial piston pump as a control pump which is regulated by a regulating device as a function of the demands with respect to volumetric flow and pressure of a load circuit supplied by it. On the suction side, the control pump is optionally provided with a partial amount of its maximum delivery volume by a feed pump, while the remaining part of the corresponding delivery quantity is drawn in directly from a storage container, bypassing the feed pump. Possibly impermissibly high vacuums on the suction side of the control pump are detected by a suction safety device which acts on the control pump via its regulating device so that the control pump delivers smaller quantities of hydraulic fluid unitl permissible operating conditions are reached.

9 Claims, 3 Drawing Sheets

AUX. CIRCULATION CIRCUIT
STEERING
POWER BRAKE
ACCUMULATOR
VALVE UNIT
CONTROL DEVICE
LOAD SHIFT VALVE
ROUTING VALVE
SUCTION SAFETY DEVICE
CONTROL PUMP
COOLER
FILTER
FEED PUMP
SCREEN
LUBRICATING POINTS
I
II
III
IV
1
2
2a
2b
3
4
5
6
7
10
11
12
12'
13
14
15
16
30
40

HYDRAULIC SYSTEM WITH SUCTION MAINTENANCE OF ITS CONTROL PUMP

BACKGROUND OF THE INVENTION

The present invention relates to a hydraulic system having an axial piston pump as a control pump.

Hydraulic systems with axial piston control pumps are being used increasingly in agricultural tractors and construction machines. In such systems, fluid under pressure is supplied by axial piston pumps which, depending on their principle of construction—oblique disk or oblique axis—make it possible to vary delivery volume of hydraulic fluid. For energy considerations, systems which are subject to load control are preferred, i.e., systems in which the specific pump delivery stream and pressure are adjusted as a function of the pressure and volume required by the load.

Axial piston pumps are typically sensitive to excessively high vacuums in their suction line. Therefore, when an axial piston control pump is employed in a vehicle, a feed pump is preferably used to convey the hydraulic fluid from a storage container into the suction line of the axial piston control pump, and thereby continuously assure sufficient fluid pressure. The feed pump utilized is, as a rule, a pump with a constant volumetric flow, such as a gear pump, and must therefor be dimensioned so that it delivers the maximum possible quantity to the control pump. This means, however, that under operating conditions in which the hydraulic circuit supplied by the control pump requires little or no pressure fluid, the amount fed by the feed pump must be diverted into the storage container. Although it is possible to use a part of this excess quantity of fluid for lubricating and cooling purposes, such as for lubricating the transmission of a vehicle, it is uneconomical to use the pump in this manner.

If one considers a load/time diagram, of, for example, agricultural tractors, it is apparent that maximum delivery of the control pump is required very rarely. Typical load/time diagrams, in fact, indicate that maximum delivery is required less than 1% of the total operating time. Moreover, if the supply of lubricating oil to the transmission depends on the feed circuit which is supplied by the feed pump, much energy can be saved through the use of smaller feed pumps.

It would be possible to adjust the feed pump such that it satisfies, in addition to the other demands made on it (e.g. lubrication), only part of the quantity required by the control pump. If the control pump however requires volumetric flows which exceed this partial requirement then the amount of hydraulic fluid in excess thereof must be drawn directly out of the storage container via an additional line. This manner of operation is, however, permissible for axial piston pumps only if certain operating conditions are satisfied. For instance, the additional line must have a suitable cross-section, and hydraulic fluid which is sufficiently warm must be used.

However, on a cold start, particularly at low outdoor temperatures, the resultant higher viscosity of the hydraulic fluid (which may be, for instance, oil) causes large pressure drops to occur already at low flow velocities in the suction line. This leads to the possibility of occurrence of, high vacuums on the suction side of the control pump, which can damage the control pump due to cavitation phenomena effects.

The object of the present invention, therefore, is to provide a hydraulic system having a feed pump and an axial piston control pump, in which the feed pump is designed optimally from an energy standpoint with regard to the load-requirement profile for the hydraulic system, while nevertheless avoiding impermissible operating conditions for the control pump.

SUMMARY OF THE INVENTION

This object is achieved in accordance with the features of the present invention. The present invention utilizes a suction safety device which, by monitoring the suction-side pressure of the control pump, detects impermissible pressure values due to blocking of the screen in the suction line or due to high viscosity of the fluid being pumped and throttles the hydraulic fluid delivery stream of the pump accordingly, so that permissible operating conditions are maintained at all times. The suction safety device acts with priority on the control pump when the suction-side pressure of the latter drops below a permissible value, the pressure and volume requirements of the load circuit being of secondary importance. The suction safety device is not activated if the suction-pressure values lie within the permissible range.

By the interaction of the suction safety device with a control device which monitors the requirements of the load circuit and actuates the control pump, regulation of the control pump by the suction safety device is possible by way of priority in a structurally simple manner.

The use of a suction safety device in the present invention as a hydraulic and hydraulically controlled routing valve provides overall control of the hydraulic system without external energy in a simple and reliable manner.

BRIEF DESCRIPTION OF THE DRAWINGS

One embodiment of the invention will be described in further detail below with reference to the diagrams of the accompanying drawings, in which.

In the drawings identical reference numerals indicate similar components.

DETAILED DESCRIPTION OF THE PREFERRED EMBODIMENT

Figure 1:
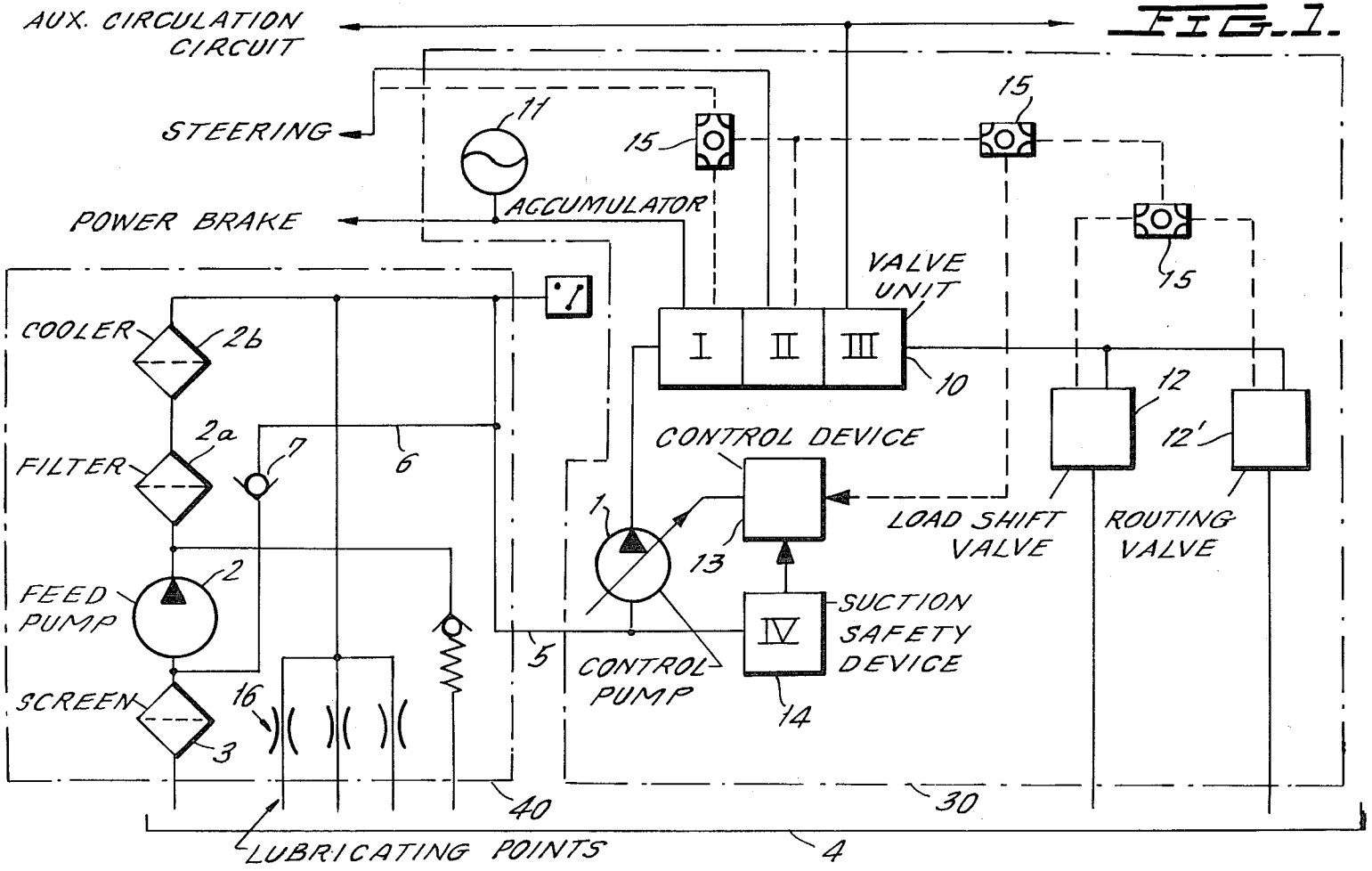
FIG. 1 is a block diagram of the hydraulic system.

The hydraulic system shown in FIG. 1 is divided into a load circuit 30 which is supplied by a control pump 1 (e.g. an axial piston pump), and a feed circuit 40 which is supplied by a feed pump 2. Feed pump 2, which may be for example, a Gerotor, supplies a constant volumetric flow of hydraulic fluid (for example, oil), through a suction screen 3 from a storage container 4 and delivers it via filter **2*a* and cooler 2*b* to the load circuit 30. Lubricating points (shown schematically at 16) and other devices of a vehicle which require an approximately constant volumetric flow are connected directly to the feed circuit 40, as is suction line 5 of the control pump. Suction line 5 is also connected via a one way valve 7 and additional line 6 directly to the storage container 4, bypassing the feed pump 2 so that additional hydraulic fluid can be obtained directly from storage container 4 when required. The output of feed pump 2 is adjusted so that it delivers an amount of hydraulic fluid which is greater than that required by the lubricating points 16 which are directly supplied by the feed circuit 40, so that this excess amount is available with sufficient pressure on the suction side of control pump 1. Hydraulic fluid may also briefly be drawn in within the feed circuit 40 upon interruption in the supply of the lubricating points connected thereto. If more hydraulic fluid is required than the feed circuit 40 can make available while maintaining its other continuously required functions, such fluid is drawn into the control pump 1 via the additional line 6 direclty from the storage container 4**.

The load circuit 30 is divided by a valve unit 10 into different load circuits. The valve unit 10 distributes the hydraulic fluid supplied by control pump 1 to various loads or consumers. By way of example, the valve unit 10 includes a storage load control valve I which cooperates with a priority valve II to supply hydraulic fluid to a steering system and an accumulator 11 for a power brake, the hydraulic fluid being fed to the steering system by way of priority over the other loads supplied by load circuit 30. Furthermore, an auxiliary-circuit valve III supplies a control circuit (not shown) a load shift valve 12 and a routing valve 12'. These later valves are connected for the alternate supplying of additional load units, such as hydraulic jacks or the like. The demand values of the different load circuits are monitored via sensors (e.g. shuttle valves) 15 by a control device 13 which applies a corresponding signal to actuators of control pump 1 and thus regulates their output and volumetric flow.

To prevent the occurrence of operating conditions which are impermissible for control pump 1 (e.g. an input pressure to the pump which is less than a predetermined value), a suction safety device 14 is provided which monitors the suction pressure immediately upstream of control pump 1 and, if the pressure is less than the predetermined amount, causes control device 13 to reduce the volumetric flow of control pump 1 by continuously changing the pivoting angle of control device 13 until permissible operating conditions are reached. Thus, suction safety device 14 causes pump 1 to reduce its output to a value below that required by the loads it feeds whenever the fluid pressure at its input falls below the predetermined permissible value. Only upon an increase of the pressure in suction line 5, occurring for instance by an increase in suction pressure upon warming up of the lubricating fluid after a cold start, is the action on control device 13 by suction safety device 14 removed, so that control device 13 can again set pump 1 to the values of pressure and volumetric flow required by the load circuit. Dashed lines indicate a load sensing circuit in which shuttle valves 15 are incorporated in order to feed back the respective higher load pressures at the respective consumers, e.g. the steering or other working units.

Figure 2:
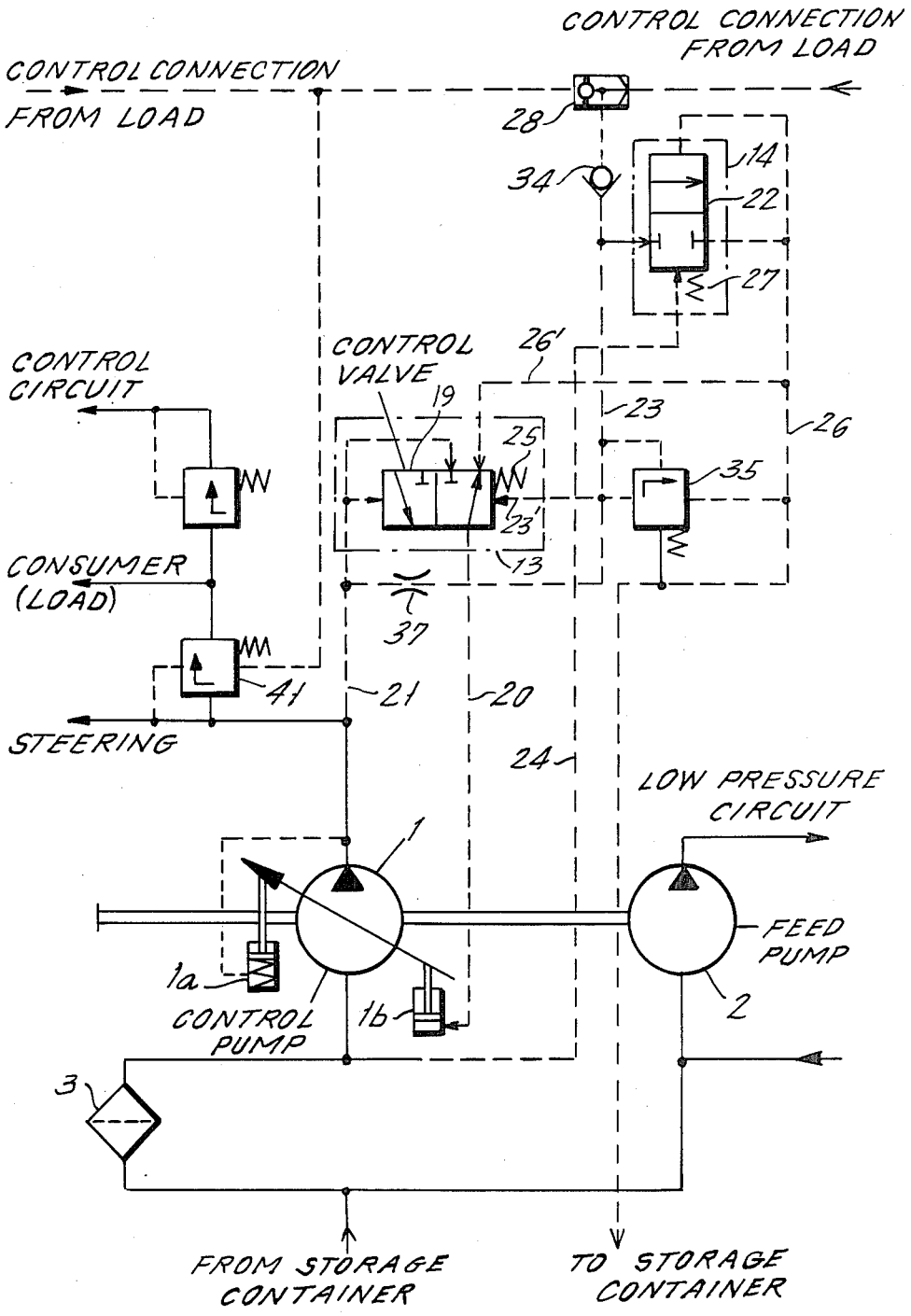
FIG. 2 is a hydraulic circuit diagram in which the suction safety device is incorporated into a control device which is controlled by a load sensing circuit.

FIG. 2 shows a circuit diagram for a preferred embodiment of the hydraulic system of the present invention which uses a 2/2-way valve as the suction safety device 14. Control pump 1 includes two setting pistons, 1*a* and 1*b*, which serve to change the pivoting angle of the pump and thereby the flow rate of the pump. Setting piston 1*a* is acted on directly by the output pressure of the pump 1 while setting piston 1*b* is subject, via a control line 20, to the setting pressure determined by a control valve 19 which is a part of the control device 13. Control valve 19 is a 3/2-way valve having a setting piston which is subject at its one end, via a control line 21, to the output pressure of control pump 1 and on its other end to a spring load 25 and to the pressure in lines 23, 23' which represent the requirements of the load circuits. Depending on the position of the setting piston in control valve 19, control line 20 is thus connected to either the storage container 4 (via lines 26, 26') or to control line 21 which is at the output pressure of the regulating pump 1. In this way, control line 20, via control valve 19, changes the pivoting angle of control pump 1. This principle of control is well known in the art.

Figure 3:
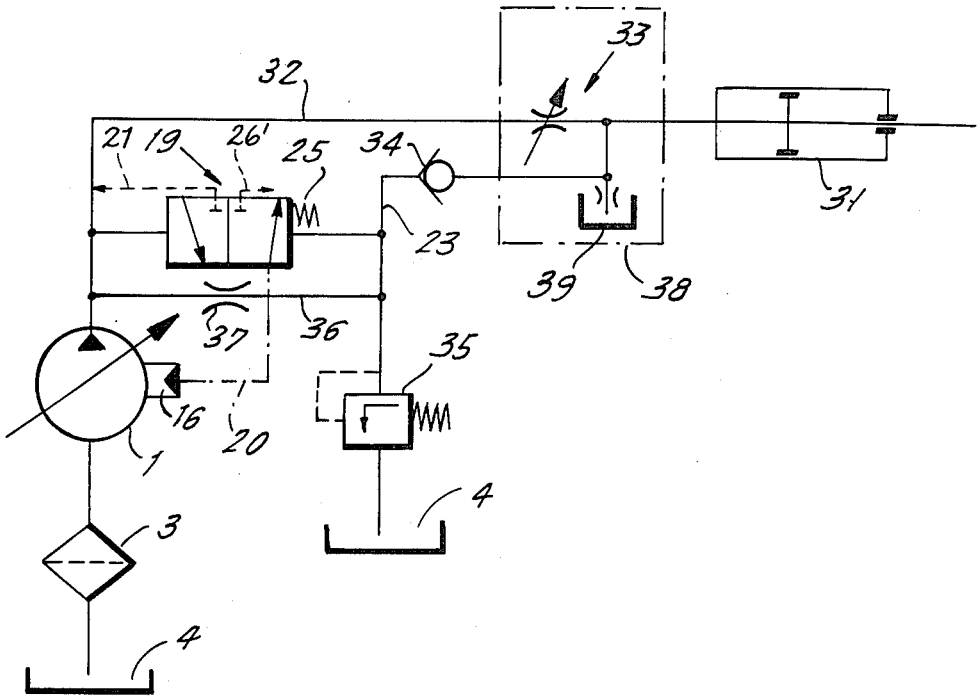
FIG. 3 is a block diagram illustrating the principle of generating control signals indicating the load of a working system by means of a load sensing circuit.

FIG. 3 shows the operating principle of the load-sensing-circuit through which the pressure in line 23 representing the requirements of the load circuits is derived. In this representation, only a single load is shown when a plurality of loads are maintained, they are connected together through a shuttle valve (or other appropriate mechanism) as described in FIG. 2.

In FIG. 3 a load in the form a power piston 31 is supplied by a pressure line 32 connected to the control pump 1. The actuation of the power piston 31 is controlled by an adjustable throttling means 33. The pressure downstream the throttling means 33 represents the level of the load 31 and this pressure is applied through a control line 23 via a backpressure valve 34 opening in direction from the load 31 to the control valve 19. The control valve 34 controls the operation of control pump 1 as described above with respect to FIG. 2. The pressure in the control line 23 also acts on a pressure relief valve 35 which is connected to the storage container 4.

The control valve 19 is bypassed by a supply line 36 in which a throttle 37 is arranged. This throttle 37 continuously supplies the control line 23 with fluid which offsets liquid fluid which occurs in the load sensing circuit, i.e. in an area of an actuating valve 38. Therefore the load sensing circuit is continuously bleeded which is schematically indicated by the reference numeral 39.

In accordance with the system of FIGS. 1 and 2, the control pump 1 feeds hydraulic fluid to a steering circuit and, via a priority valve 41, to a load circuit for the supply of further loads. The level of each load being supplied is detected by a load sensing circuit, the control connections of which are indicated by dotted lines in FIG. 2. The pressures of the respective control connections are applied to a shuttle valve 28 so that only the highest of these pressures is connected to the control line 23.

Returning to FIG. 2, the suction safety device 14 comprises routing valve 22 which, depending on the position of its setting piston, makes or breaks a connection between control line 23 (which conducts the pressure of the control connections and acts on the setting piston of control valve 19), and the line 26 to the storage container 4. The control line 23 is coupled to the hydraulic loads or consumers being fed by pump 1 and is maintained at a pressure indicative of the pressure requirements of the loads. The setting piston of routing valve 22 is free of pressure on one end (i.e. the end subject to the pressure of the storage container 4), while its other end is spring-loaded at 27 and is connected via a vacuum line 24 to the suction (input) side of control pump 1. Furthermore, control line 21, which is connected on the output side of the control pump 1, is connected via a choke 37 with control line 23 and thus with one connection of the routing valve 22 of the suction safety device 14.

As long as the vacuum detected by vacuum line 24 on the suction (input) side of the control pump 1 does not drop below a predetermined value, the setting piston of routing valve 22 holds the two connections thereof apart, so that there is no connection between control line 23 and the storage container 4. Control valve 19 thus operates independently of the suction-side pressure of the control pump 1 and adjusts the latter, in accordance with the demands of the load circuit, as a function of the pressure applied via the control connections.

If the suction pressure of the control pump 1 drops below the predetermined value and impermissible operating conditions are thus reached, the high vacuum present on line 24 causes the setting piston of routing valve 22 to shift into its closed position, as a result of which line 23 is connected to the storage container 4 via line 26. The setting piston of the control valve 19 is thus displaced in the direction towards smaller delivery quantities of hydraulic fluid by control pump 1. Furthermore, an additional pressure drop in control line 21 takes place over the choke 37. As a result of this control pump 1 is displaced in the direction of smaller delivery quantities and permissble operating conditions are maintained. Only after a suction (pump input) pressure above the predetermined value has built up is the setting piston pushed into its blocking position. In that position, the connections of the routing valve 22 are separated so that control valve 19 operates independently of the suction safety device 14, responding instead to the pressures of the control connections on control line 22.

The predetermined value which controls the action of the suction safety device 14 in the control circuit of the control device 13 can be set by properly selecting the size of the end surface of the setting piston of the routing valve 22 and by adjusting the spring force of spring 27.

In summary then, the present invention is a hydraulic system having an axial piston pump as a control pump which is regulated by a regulating device as a function of the demands with respect to volumetric flow and pressure of a load circuit supplied by it. On its suction side, the control pump can be provided or supplied with a partial amount of its maximum delivery volume by a feed pump, while the remaining part of the corresponding delivery quantity is drawn-in directly from a storage container, bypassing the feed pump. The occurrance of impermissibly high vacuums on the suction side of the control pump are detected by a suction safety device which acts on the control pump via its regulating device so that the control pump delivers smaller quantities of hydraulic fluid until permissible operating conditions are reached.

Although the invention has been described with respect to its preferred embodiment, it should be understood that many variations and modifications will now be obvious to those skilled in the art, and it is preferred, therefore, that the scope of the invention be limited not by the specific disclosure herein but only by the appended claims.

What is claimed is:

1. A hydraulic system comprising:

a control pump for supplying hydraulic fluid to a load circuit, said control pump being coupled at its input to a storage container containing hydraulic fluid and said hydraulic fluid flowing into said control pump at a measurable suction-pressure; and control means for controlling said control pump such that during a normal control mode said control pump is responsive to hydraulic fluid demands of said load circuit and further such that, when said measurable suction-pressure falls below a predetermined value, said normal control mode is overridden and said control pump is controlled such that the volume of hydraulic fluid being supplied by said control pump to said load circuit varies as a function of the actual pressure of said suction-pressure.

2. A hydraulic system according to claim 1, further comprising means for regulating said control pump, said regulating means monitoring the demands of said load circuit and producing a regulating signal for said control pump in accordance with said load demands to effect a readjustment of said control pump.

3. A hydraulic system according to claim 2, wherein said monitoring means comprises a valve, said valve having two connections and a setting piston which may assume one of two positions in accordance with said pressure at the input of the control pump, said two connections being isolated when said setting piston assumes said first position, said two connections being joined when said setting piston assumes said second position.

4. A hydraulic system according to claim 3, wherein said first connection of said valve is connected to said storage container containing hydraulic fluid and said second connection is connected to a control line whose pressure represents the demand of said load circuit and which actuates a control valve of said regulating means.

5. A hydraulic system according to claim 4, wherein said control line is connected by a choke to a second control line which carries the pressure at the output of said control pump, said pressure being applied to a setting cylinder of the control pump by said regulating means.

6. A hydraulic system according to claim 3 wherein regulating means is coupled to a load sensing circuit which indicates the demands of said loads and said valve is connected to said regulating means in such a manner that said regulating means produces said regulating signal independently of said demands of said load whenever pressure at the output of said pump falls below a predetermined value.

7. A hydraulic system according to claim 6, wherein said valve causes said regulating means to generate a regulating signal which reduces the volume of hydraulic fluid supplied by said pump whenever said pressure at the output of said pump falls below said predetermine value.

8. A hydraulic system according to claim 1, further includes a feed pump for feeding hydraulic fluid to said control pump.

9. A hydraulic system according to claim 1, wherein said control pump includes fluid-flow regulating means for regulating the flow of said hydraulic fluid through said control pump and wherein said control means includes a control valve coupled to said fluid-flow regulating means of said control pump, said control valve having a normal valve position which operates said control pump to its said normal control mode and an override valve position which operates said control pump to its override control mode and including suction-pressure monitoring means, responsive to said measurable suction-pressure at said input into said control pump, coupled to said control valve, and effective for causing said control valve to assume said override valve position when said measurable suction-pressure falls below said predetermined value.

* * * * *